US008438879B2

(12) United States Patent
Gokceimam et al.

(10) Patent No.: US 8,438,879 B2
(45) Date of Patent: May 14, 2013

(54) HOUSEHOLD APPLIANCE

(75) Inventors: Eyyup Gokceimam, Istanbul (TR); Sertac Yilmaz, Istanbul (TR); Cigdem Erbug, Istanbul (TR); Aydin Oztoprak, Istanbul (TR); Ali Emre Berkman, Istanbul (TR)

(73) Assignee: Arcelik A.S., Istanbul (TR)

( * ) Notice: Subject to any disclaimer, the term of this patent is extended or adjusted under 35 U.S.C. 154(b) by 691 days.

(21) Appl. No.: 12/513,140

(22) PCT Filed: Oct. 31, 2007

(86) PCT No.: PCT/IB2007/054419

§ 371 (c)(1),
(2), (4) Date: Jan. 20, 2010

(87) PCT Pub. No.: WO2008/053438

PCT Pub. Date: May 8, 2008

(65) Prior Publication Data

US 2010/0126493 A1 May 27, 2010

(30) Foreign Application Priority Data

Oct. 31, 2006 (TR) ..... a 2006 06051

(51) Int. Cl.
*D06F 33/02* (2006.01)
*A47L 15/46* (2006.01)
*F24C 15/00* (2006.01)

(52) U.S. Cl.
USPC ..... 68/12.23; 134/56 R; 126/273 R

(58) Field of Classification Search ..... 68/3 R, 68/12.12, 12.23, 12.27; 134/56 R, 113; 700/17, 700/83, 90; 126/273 R
See application file for complete search history.

(56) References Cited

U.S. PATENT DOCUMENTS

| | | | | | |
|---|---|---|---|---|---|
| 4,763,493 | A * | 8/1988 | Nishite et al. | 68/12.27 |
| 5,682,206 | A * | 10/1997 | Wehmeyer et al. | 725/58 |
| 5,839,097 | A * | 11/1998 | Klausner | 340/12.3 |
| 6,425,156 | B1 * | 7/2002 | Knopp et al. | 8/159 |
| 6,502,265 | B2 * | 1/2003 | Blair et al. | 8/159 |
| 6,853,399 | B1 * | 2/2005 | Gilman et al. | 348/61 |
| 6,934,592 | B2 * | 8/2005 | Hood et al. | 700/83 |
| 7,453,439 | B1 * | 11/2008 | Kushler et al. | 345/168 |
| 7,503,088 | B2 * | 3/2009 | Jo et al. | 8/158 |
| 7,516,629 | B2 * | 4/2009 | Behrens et al. | 68/12.12 |
| 7,658,806 | B2 * | 2/2010 | Jeong et al. | 134/56 D |
| 2004/0134238 | A1 | 7/2004 | Buckroyd | |
| 2004/0156170 | A1 * | 8/2004 | Mager et al. | 361/683 |
| 2006/0265084 | A1 | 11/2006 | Moon | |

FOREIGN PATENT DOCUMENTS

| | | | |
|---|---|---|---|
| DE | 29714901 U1 | | 12/1998 |
| DE | 100 35 642 | * | 12/2001 |
| WO | 2005/113880 A | | 12/2005 |

* cited by examiner

*Primary Examiner* — Joseph L Perrin
(74) *Attorney, Agent, or Firm* — Venable, Campillo, Logan & Meaney PC

(57) ABSTRACT

The present invention relates to a household appliance (1), constituting a display (3) which enables the user to observe the performance state of the household appliance (1) and one or more input units (2) that enable the user to make visual or audio data entries.

13 Claims, 3 Drawing Sheets

HOUSEHOLD APPLIANCE

Figure 1:
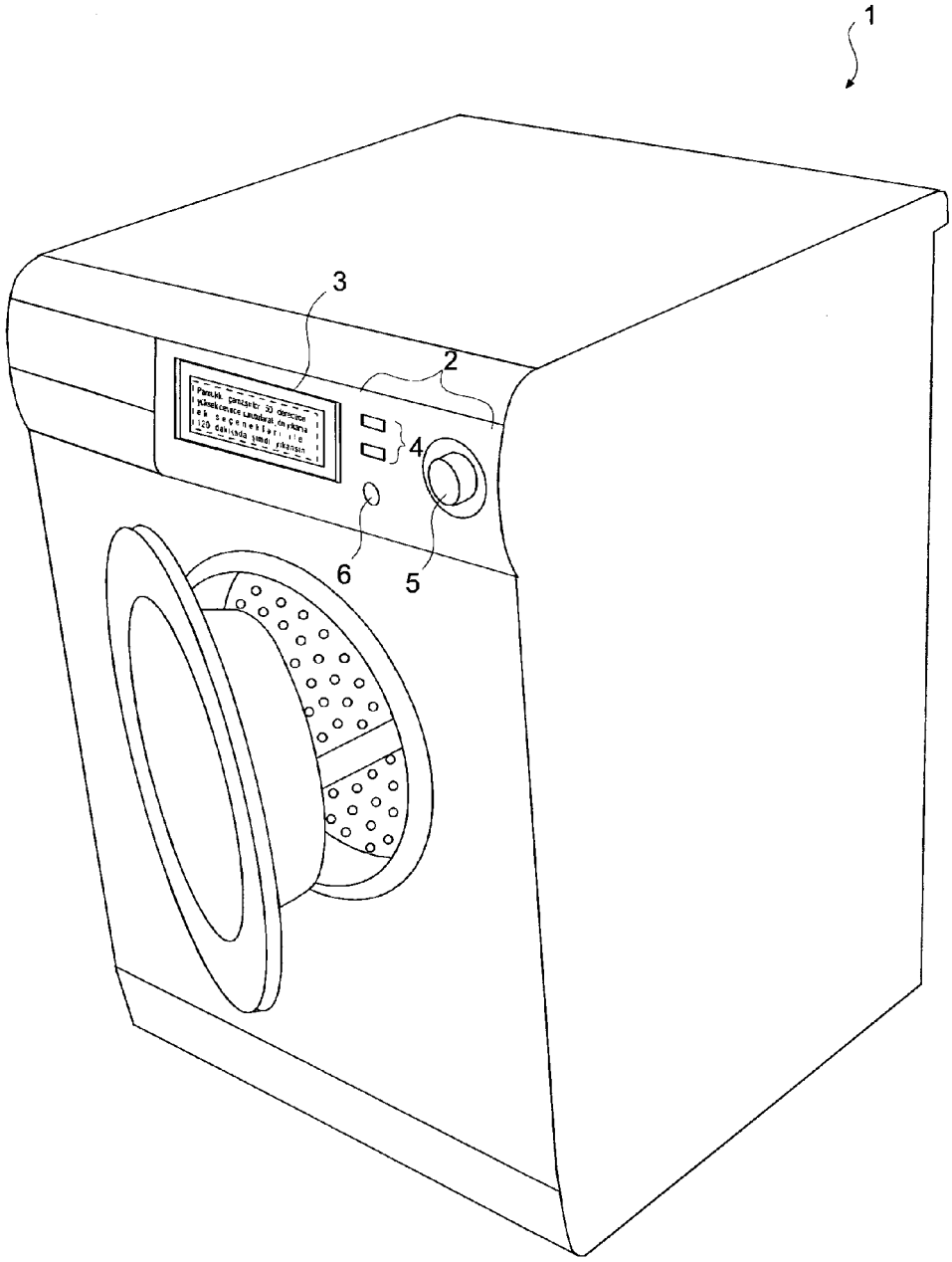

This invention relates to a household appliance easily programmable by a user.

In the state of the art, household appliances can be programmed by a user only within the manufacturer's permissive limits. To allow a user the control of the working process, most household appliances, especially appliances like cookers, cooling devices, washers/dryers, and dish washers, make use of data input devices such as buttons, keyboards, keys, touch control displays, and the like. Nonetheless, data output devices such as screens and display assemblies which inform the user through visual or audio signals about the performance state of a household appliance (temperature, humidity, pressure, operating cycle, and other similar specifications) are also located on the control panel.

In most of the state of the art embodiments, the working process of a household appliance containing various steps is controlled simply by selecting one of the options indicated on the interface. However, users are frequently puzzled in selecting the option corresponding to the function they desire among all other options offered on the interface.

In most of the state of the art embodiments, every operating step of a household appliance is illustrated on the display. In such embodiments, the user can follow the various operating steps of a household appliance through different symbols, signs, similar marks, and twinkling signal lights. Although each parameter value regarding the working process is indicated, the user is not equipped with sufficient information as to which parameter activates a specific operation. Furthermore, it is quite unclear to distinguish between variable fields wherein the user can make modifications or data entries, and the invariable fields which are simply information areas.

The state of the art embodiments make use of progressive programming method. According to this method, once a specific operating step is performed, the interface is restored, and a new interface containing the functions of the following step appears on the display.

In the state of the art the U.S. Pat. No. 7,059,003 relates to a household appliance, wherein the interface placed on a display consists of several pages, and on each page, the user is presented several convertible working process parameters. On this document, each interface is assigned a number in order to facilitate transition from one interface to the other. These numbers inform the user whether or not a specific operating step of the program has been completed.

In such embodiments, the signs constituting a special language for the household appliance and symbolizing the working process which are installed into the household appliance by the manufacturer, usually revealing differences from one manufacturer to the other, should be understood and learned by the end user. A user who is unfamiliar with the programming method of the household appliance will never be able to learn its various working processes or select the correct parameters for a specific program if the symbols representing that particular working process are not grasped.

The object of the present invention is to realize a household appliance containing a display which will allow the user to easily perceive and program the working process.

The household appliance designed to fulfill the objective of the present invention, explicated in the first Claim and the respective Claims thereof, comprises a display which illustrates all the steps describing a working process in one or more sentences composed of words that describe the parameters, parameter values, and operations to perform.

This sentence depicts in detail the operation of the household appliance. Not only it indicates the names of the parameters, their corresponding values, and the procedure of the operating process, but it is also a complete sentence where grammatical elements such as verbs, prepositions, adverbs, pronouns, conjunctions, and punctuation marks are used. The user amends only the parameter values without altering any other element in the sentence. The sentence structure remains the same while amending the parameter values.

On the display which becomes active when the household appliance is switched on, the variable fields which may be changed by the user may be empty, or the minimum values that may be selected for the variable field (A) may be exposed, or the values which are most frequently used by the user may be exposed, or all values attributable to this field (A) may be exposed.

This invention serves more or less like a "blackboard" on which one can program over and over again. The user needs simply to change the values corresponding to the parameters expressed in the sentence and recompose the working process and reprogram the household appliance. In each modification procedure, only the value changes. The program definition is modified simply on the basis of parameter values, the sentence structure remaining unchanged. It is only when a household appliance contains more than one working process that several different sentences are employed, each one defining a particular process. The display then displays the sentence corresponding to the process selected by the user.

In one embodiment of the present invention, all values describing a working process and the words describing those values can be observed at the same time on the display. While modifying a value, the user has therefore the possibility of tracing all other associated values, both prior and subsequent ones, together with their definitions.

In one other embodiment of the present invention, the function of the parameter selected by the user is defined in a sentence that includes the parameter. Therefore, the user can change the values of a parameter without having to search for further information as to its specifications (e.g. the expression "high speed drying" is employed instead of "1000 rpm".)

In another embodiment of the present invention, when one of the values of a working process is modified, the new value and the sentence or word(s) which define this new value are progressively inserted into the sentence which describes the previous value. Thus, by such inclusion of new sentences that depict a working process, the entire process can be observed on the display at the end of the programming.

In another embodiment of the present invention, in order to easily distinguish between the parameters for which values have been selected and those for which values have not yet been selected, variable fields with selected values are marked differently from those without selected values. Therefore, the user can easily understand the fields into which new values can be entered.

In another embodiment of the present invention, a value entered in one variable field determines the values in another variable field. This not only prevents the user from making an incorrect programming but also enables the selection of the best fit value among many others.

The display of the present invention can be easily applied into all household appliances such as washing machines, dishwashers, driers, cooking devices, refrigerators, etc.

With this invention the user can see all of the parameters that would be set up on the display. Programming the working process of a household appliance appears no longer complicated or too technical thanks to this user-friendly "Sentence Based Interface", which enables the user to perform the entire programming in one single sentence.

Figure 2:
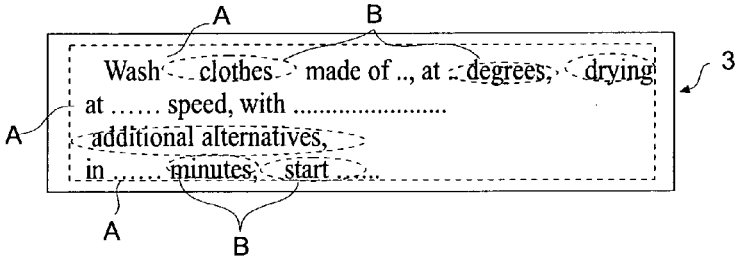
Figure 3:
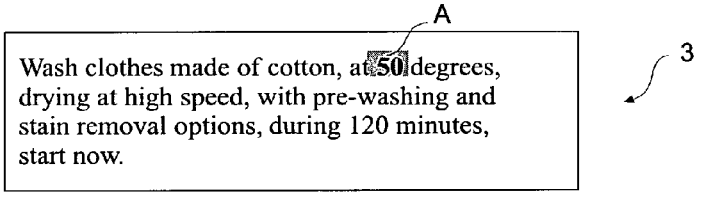
Figure 4:
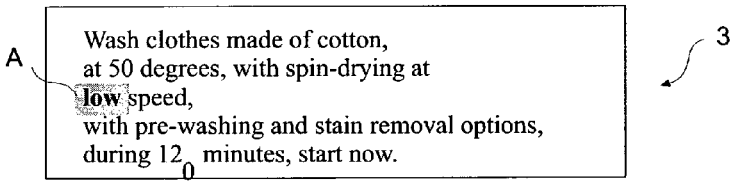

A household appliance designed to fulfill the objective of the present invention is illustrated in the attached figures, where:

FIG. 1—represents a perspective view of a household appliance,

FIG. 2—represents the display, object of the present invention, in active position when all variable fields are empty, FIG. 3—represents the display, while changing a value on the first variable field, FIG. 4—represents the display while changing a value in another variable field, FIGS. 5-10 represent the display in one other embodiment of the present embodiment, wherein the entire process can be observed step by step through inclusion of successive sentences.

The elements shown in the figures are numbered as follows:

1. Household appliance
2. Input device
3. Display
4. Field toggle key
5. Select button
6. Start button The household appliance (1) of the present invention comprises of one or more input devices (2) enabling the user to enter input data, as well as a display (3) on which the user can observe the performance state of the appliance (FIG. 1).

The input device (2) comprises of one or more buttons (4, 5, and 6).

The display (3) may be in various sizes, LCD or similar type, with single or multiple lines.

Displaying the parameters constituting a working process and their corresponding values, and the actions to take thereon according to these parameters when the household appliance (1) is switched on in one sentence to the user on the display (3) enables the user to modify a parameter value without altering the sentence structure but by changing within the sentence that specific value, and allows the user to observe all parameters and their values at the same time.

The sentence comprises association of one or more variable fields (A) containing the parameters of a working process, the values of which can be modified by the user, and an invariable field (B), consisting of other elements comprising the sentence which defines the parameters, the parameter values, and the actions to perform that the user is not allowed to change.

All parameters of a working process, their corresponding values, and the actions to perform once the household appliance (1) is switched on, are expressed in one sentence using expressions in the form of grammatical elements like verbs, prepositions, adverbs, pronouns, conjunctions, and punctuation marks. The user modifies a parameter values without altering any other element in the sentence. The sentence structure remains the same when changing the parameter values. The only likely intervention in the invariable field (B) is when a modification in the variable field (A) requires a grammatical adjustment in the invariable field (B), (such as a plural suffixes, vowel harmony, case endings, etc.).

The sentence appearing on a display (3) is developed to define the working process of the household appliance (1) and remains in compliance with grammatical rules. Parameter values in the variable field (A) are modifiable, but the words composing the sentence in the invariable field (B) which the user cannot intervene, cannot be changed by the user. The display (3), thus, enables the user to easily discern the amended parameters, see whether or not the modification selections are correct, and how the working process will evolve.

When the household appliance (1) is switched on the display (3) that illustrates in one sentence the parameters of a working process is activated. At this position, the variable field (A) where the user is allowed to intervene may be entirely empty (FIG. 2) or it is also possible that in this variable field (A) either the minimum values or the most frequently preferred values are exposed (FIG. 3), or a complete list is given, among which the user may select a value to attribute to this field (A). The user employs the keys (4, 5, and 6) and/or their (4, 5, and 6) various combinations to enter into the variable field (A) in order to change a parameter value related to the working process of the household appliance (1). Once a value is selected to attribute to this field (A), the user passes over the invariable field (B) containing the words that are not allowed to be modified, and goes to the next variable field (A). Thus, the user can trace the entire working process of the household appliance (1) on the display (3) together with the corresponding parameters and different values that can be attributed to each parameter and can program the process within the limits permitted by the producer.

The preferred embodiment of the present invention is the one which allows the user, while programming a working process for the household appliance (1), to watch on the display (3) simultaneously both the variable fields (A) containing parameter values, and the invariable field (B) which cannot be intervened, disposing the definitions of such values (FIG. 3 and FIG. 4). Thus, the user can follow which parameter value(s) are allowed to be changed for a certain working process of the household appliance (1), can see the stage of the working process, and observe the other parameters to be defined on the display (3).

In yet another embodiment of this invention, while selecting a value in any one of the variable fields (A) the user can simultaneously observe on the display (3) not only that particular variable field (A) but also the concerned invariable field (B) which contains a sentence that defines the said field (A) and the selected value, together with the other fields (A and B) corresponding to all previously selected parameters. In this embodiment, the sentence which depicts the working process develops step by step as words are added into the next variable field (A) and into the invariable field (B) that defines the values indicated therein (A). The sentence depicting a working process becomes complete and visible on the display (3) once the last value in the last variable field (A) is selected (FIG. 5 to FIG. 10). It is therefore clear for the user to see whether or not there remains any other modification to effectuate and, does not mistake the area to be selected.

In this embodiment of the present invention, when the household appliance (1) is switched on, the display (3) displays in the first instance a sentence wherein the first parameter value that the user is to change is also designated.

Figure 5:
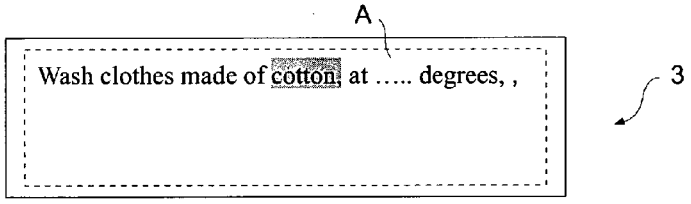

For example, the first sentence may be in this form:

"Clothes made of {cotton, linen, silk, wool, other}". Once the selection is made by the user the sentence becomes:

"Clothes made of cotton" (FIG. 5).

Figure 6:
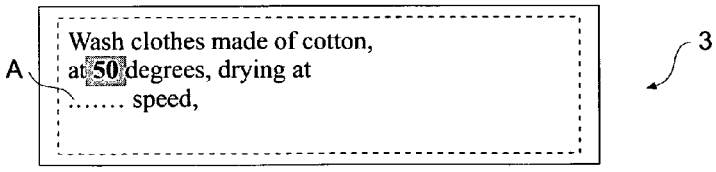

Immediately after this selection, a new phrase is inserted into the first sentence as:

"Clothes made of cotton at {30, 40, 50, other} degrees", with possible alternatives concerning the next parameter values. When the user makes a selection, the display (3) displays the following sentence:

"Clothes made of cotton, at 50 degrees" (FIG. 6).

Now, the user is offered a new sentence,

"Clothes made of cotton, at 50 degrees, drying at {high, low, 100-1000, other} speed".

Figure 7:
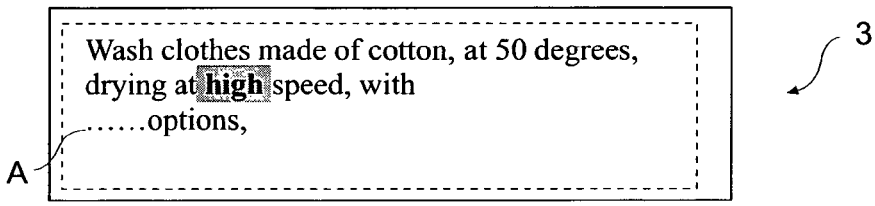

The user makes the selection and the sentence changes into the following:

"Clothes made of cotton, at 50 degrees, drying at high speed" (FIG. 7).

A new sentence is inserted at the next step, offering additional options:

"Clothes made of cotton, at 50 degrees, drying at high speed, with additional options {pre-washing, stain removal, other}"

Figure 8:
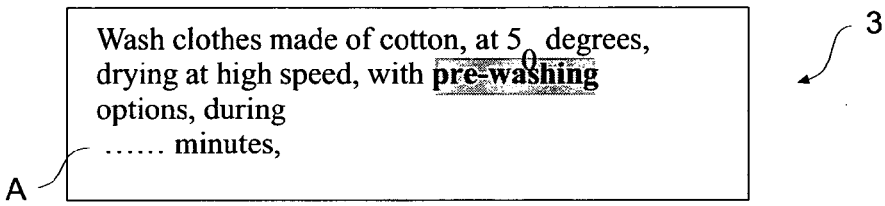

The user makes a selection and the sentence becomes:

"Clothes made of cotton, at 50 degrees, drying at high speed, with pre-washing options" (FIG. 8).

At this stage of the programming, a new sentence is inserted into the sentence which now is:

"Clothes made of cotton, at 50 degrees, drying at high speed, with pre-washing options, during {30, 60, 90, 120, other} minutes".

Figure 9:
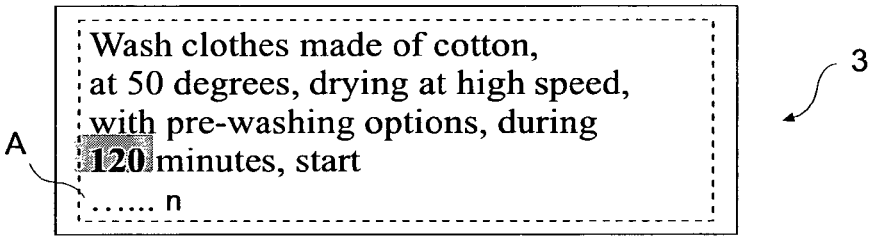
Figure 10:
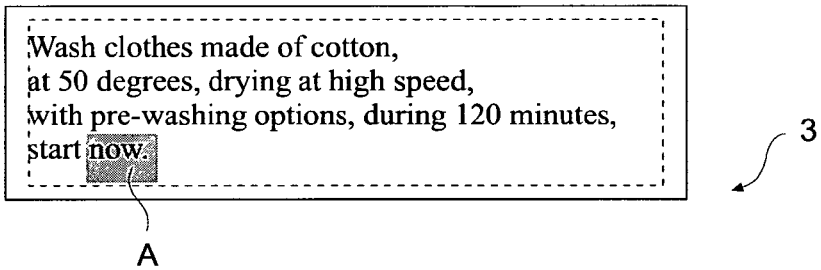

When the user makes the selection, the sentence becomes:

"Clothes made of cotton, at 50 degrees, drying at high speed, with pre-washing options, during 120 minutes" (FIG. 9).

And now appears the very last sentence indicating that the programming of the household appliance (1) has come to an end:

"Wash clothes made of cotton, at 50 degrees, drying at high speed, with additional pre-washing options, during 120 minutes, start {now, 30 minutes later, other}"

The user knows that the inclusion of this sentence signifies the completion of the programming.

When the selection is made, the sentence:

"Wash clothes made of cotton, at 50 degrees, drying at high speed, with pre-washing options, during 120 minutes, start now" (FIG. 10), appears on the display, thus, the programming procedure of the household appliance (1) is completed and the household appliance (1) starts functioning in line with the parameters indicated in the above sentence.

In one other embodiment of the present invention, the variable field (A) where values have been entered while the programming of the household appliance (1) by the user, are marked differently from the variable fields (A) where there has not yet been any value entry. For example, while the values in the variable fields (A) the parameter value of which have been changed remain constant, the variable fields (A) the values of which have not been changed yet flash or are highlighted until the programming procedure comes to an end. Thus, it becomes easy for the user to distinguish between the selected parameter values and the unselected parameter values. The user can, therefore, see on the display (3) all parameters, the values of which can be changed.

In another embodiment of the present invention, a value selected in one variable field (A) determines the values in another variable field (A). Therefore, in the next step, the user is given a choice between a fewer number of values that correspond exactly to the value of the previous variable field (A). This, not only prevents the user from making an incorrect programming but also enables the selection of the best fit value among many others.

In another embodiment of the present invention, selecting a variable field (A) enables the user to observe all of the parameter values of that field (A) in one single line. For example, the sentence "Wash clothes made of (cotton, linen, silk, wool, other); at (30, 40, 50, other) degrees, drying at (high, low, 100-1000, other) speed; in (30, 60, 90, 120, other) minutes; start (now, 30 minutes later, other)" is projected on the display (3). As seen in this example, all values that can be selected in the variable fields (A) that can be changed by the user can be observed on the display.

In another embodiment of the present invention, once a variable field (A) is selected, all values thereon (A) are listed and projected in form of a menu on a single column. Thus, the sentence is shortened, and the user is enabled to trace the value changes clearly.

In another embodiment of the present invention, the household appliance (1) comprises of one or more field toggle keys (4) that enable transition between the variable fields (A) in the sentence. In this embodiment, by employing the field toggle keys (4), the user can pass between the fields (A) within a sentence where the values belonging to the parameters which are permitted by the manufacturer are placed.

In this embodiment, the household appliance (1) also comprises one or more select buttons (5) that enables the selection of one of the values of a parameter among others within the selected area (A). The user, in this embodiment, can replace a certain value with an alternative value within a given variable field (A) by using these select buttons (5). Every time one of these select buttons (5) is pressed, the parameter values of the concerned variable field (A) are disposed to the option of the user.

In addition, in this same embodiment, the household appliance (1) comprises of a start button (6) employed to launch the working process as defined in the sentence appearing on the display (3). In this embodiment, pressing this button (6) starts the working process as indicated on the display (3).

The display (3) which constitutes the object of the present invention is most preferably used in a washing machine. In such embodiments, once the washing machine is switched on, a model sentence appears on the display (3) like the following:

"Wash clothes made of {cotton, linen, silk, wool, etc.}; at {30, 40, 50, etc. vb.} degrees, drying at {high, low, 100-1000, etc.} speed; in {30, 60, 90, 120, etc.} minutes; start {now, 30 minutes later, etc}" (FIG. 2).

Alternative values like fabric type, washing temperature, spin-drying speed, pre-washing, low-energy washing, stain removal and values related to required time which the manufacturer permits the user to change and consequently the user can program the working process are presented in a sentence structure together with words that define the process that can be followed by the user.

The first action to perform is to press on a field toggle key (4) in order to select a field (A) where values for fabric types are stored in memory. Once the field (A) is selected, the user can press on a select button (5) to list the values corresponding to various fabrics in that particular field (A), and select a value which the user wishes to apply for fabric parameter. When the value to be applied is selected, skipping the other invariable fields (B) which are placed in the sentence the user reaches the next variable field (A) by using the field toggle key (4), and follows the same procedure as above to select the desired values. By this way, the washing program defined on the display (3) in a sentence is completed by the user and pressing on the start button (6) the program starts.

In the above-mentioned example, when the user completes all value selections and accomplishes the programming of the household appliance (1), the sentence on the display (3) reads as follows:

"Wash clothes made of cotton, at 30 degrees, drying at high speed, in 60 minutes, start 30 minutes later.

In one other embodiment, the display (3) of the present invention is used in a cooker. Once the device is switched on, the user observes on the display (3) a model sentence like this:

"Cook {bottom, top, middle, other} tray, at {150, 180, 210, other} degrees, using {fan, turbo fan} and {bottom, top, other} heating, during {30, 60, 90, 120, other} minutes, start {now, 30 minutes later, other}."

The display (3) of the present invention, in another embodiment, is used in a dishwasher. When the dishwasher is switched on, the sentence that appears on the display (3) is as follows:

"Wash {bottom, top, other} basket, at {high, low, medium} temperature, using {fragile, low-energy, other} additional option, start {now, 30 minutes later, other}."

All sentences that enable a user to observe the working process of a household appliance (1) are stored in memory of the appliance (1) in several languages (Turkish, English, Spanish, French, Chinese, etc.) by the manufacturer. All sentences that are stored in memory are in compliance with the sentence formation rules of those languages.

Owing to the display (3) which displays the sentence illustrating the working process of the program, the user can reprogram the working process (1). Description of a working process in one sentence through the "Sentence Based Interface" method simplifies and accelerates both the programming of the household appliance (1) and information obtaining while setting the working process.

The invention claimed is:

1. A household appliance (1) comprising one or more input devices (2) that enables data entry by a user and a display (3) that allows the user to observe performance state of the household appliance (1) and wherein the display (3) is adapted to display all the parameters that constitute a working process, their corresponding values and actions that will be taken according to these parameters in one sentence, and to enable the user to modify a parameter value without altering the sentence structure but by changing within the sentence that specific value, and to allow the user to observe all parameters and their values at the same time wherein the display (3) is adapted to display the sentence wherein the sentence comprises an association of one or more variable fields (A) and an invariable field (B), wherein the one or more variable fields (A) contain the parameters of a working process, the values of which can be modified by the user and wherein the invariable fields (B) includes other elements comprising the sentence, the invariable field (B) defining the parameters, the parameter values, and the actions to perform that the user is not allowed to change, and wherein a value selection in one particular variable field (A) may restrict the values in another variable field (A).

2. The household appliance (1) as described in claim 1, wherein the display (3) which displays the names of the parameters of a working process, the values corresponding to each parameter, and the operation to execute once the household appliance (1) is switched on, in a sentence using sentence of elements such as verbs, prepositions, adverbs, pronouns, conjunctions.

3. The household appliance (1) as described in claim 1, wherein the display (3) whereupon the user while performing the programming can observe simultaneously all variable fields (A) containing parameter values, and invariable fields (B) containing the words that qualify the values listed in the variable fields (A) but wherein the user is not allowed to effectuate any change whatsoever.

4. The household appliance (1) as described in claim 1, wherein the display (3) which allows the user to observe simultaneously the sentence constituting the words placed on the variable field (A) while parameter value is being selected on the variable field (A), the invariable field (B) where the user can not access, and all former fields (A and B) concerning the previously selected parameters.

5. The household appliance (1) as described in claim 1, wherein the display (3), wherein variable field (A) with selected values are marked differently from variable field (A) without yet selected values.

6. The household appliance (1) as described in claim 1, wherein the display (3) which displays in one line the list of all values of a selected variable field (A).

7. The household appliance (1) as described in claim 1, wherein the display (3) which displays by enabling the user to observe in one column in form of a menu the list of all values of a selected variable field (A).

8. The household appliance (1) as described claim 1, further comprising one or more field toggle keys (4) that enable transit between various variable fields (A) of a sentence.

9. The household appliance (1) as described in claim 1, further comprising one or more select buttons (5) which enable the selection of one of the parameter values among the more than one parameter values in the selected area (A).

10. The household appliance (1) as described in claim 1, further comprising a start button (6) which starts the working process that the sentence on the display (3) describes.

11. The household appliance (1) as described in claim 1, wherein the household appliance is a washing machine.

12. The household appliance (1) as described in claim 1, wherein the appliance is a cooking device.

13. The household appliance (1) as described in claim 1, wherein the appliance is a dishwasher.

* * * * *